US006824182B2

(12) United States Patent
Graham

(10) Patent No.: US 6,824,182 B2
(45) Date of Patent: Nov. 30, 2004

(54) PLASTIC GROCERY BAG CARRYING DEVICE

(76) Inventor: Rex James Graham, 16400 Collins Ave. Apt. 1246, Sunny Isles, FL (US) 33160

( * ) Notice: Subject to any disclaimer, the term of this patent is extended or adjusted under 35 U.S.C. 154(b) by 0 days.

(21) Appl. No.: 10/301,210

(22) Filed: Nov. 21, 2002

(65) Prior Publication Data

US 2003/0102683 A1 Jun. 5, 2003

Related U.S. Application Data

(60) Provisional application No. 60/335,272, filed on Dec. 4, 2001.

(51) Int. Cl.[7] ..... B65D 33/06; A45C 13/26

(52) U.S. Cl. ..... 294/137; 294/153

(58) Field of Search ..... 294/26, 137, 153–156, 294/158, 166, 170; 16/406, 422, 425, 428; D9/434

(56) References Cited

U.S. PATENT DOCUMENTS 5,316,356 A * 5/1994 Nutting ..... 294/118
5,518,486 A * 5/1996 Sheeler ..... 482/131
5,722,118 A * 3/1998 Hansen et al. ..... 16/113.1
5,848,816 A * 12/1998 Hancock ..... 294/15
5,878,853 A * 3/1999 DeRouen et al. ..... 190/116
5,971,458 A * 10/1999 Contreras et al. ..... 294/150
6,089,636 A * 7/2000 Harris ..... 294/150

FOREIGN PATENT DOCUMENTS

GB 242069 * 11/1925 ..... 294/137

* cited by examiner

*Primary Examiner*—Dean J. Kramer

(57) ABSTRACT

A bag carrying device that will allow an individual to carry and contain multiple plastic grocery bags with the use of one hand comfortably. The bag carrying device is lightweight, compact and can be stored in a handbag or pant pocket. The bag carrying device is comprised of a horizontal tubular shaped handle. The horizontal handle will be covered with a soft foam hand grip. The inside of the tubular shaped handle is hollow allowing a flexible connecting member to be inserted directly through the center of the tubular handle extending and tapering downward and adjoining to a fastening device with a safety gate. The fastening device with a safety gate will allow the user to attach and remove multiple plastic grocery bags with ease preventing the user from having to attach one bag at a time or balance bags on separate hooks.

4 Claims, 3 Drawing Sheets

PLASTIC GROCERY BAG CARRYING DEVICE

Figure 1:
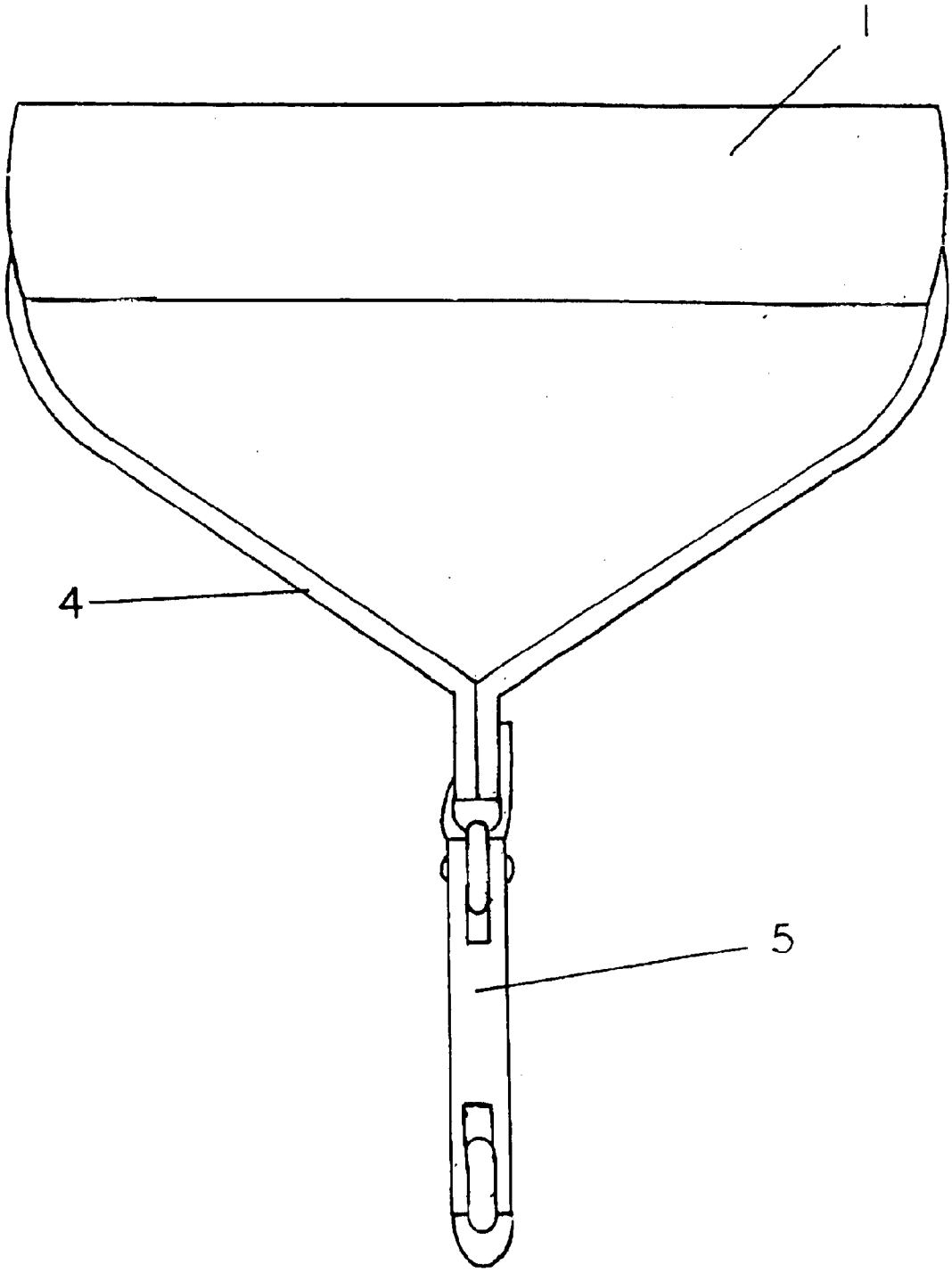

References shall be made to Provisional application No. 60/335,272 filed on Dec. 24, 2001.

FIELD OF THE INVENTION

The present invention relates to a carrying device for plastic bags commonly used in supermarkets, discount stores, drug stores, or any other industry using plastic bags to carry merchandise from the store to the home. More specifically, this invention relates to a carrying device used to carry and contain multiple plastic bags using one hand.

BACKGROUND OF THE INVENTION

In North America and much of Europe, plastic bags have become one of the most popular types of bag used to carry merchandise. When groceries are packed into the bags, there are usually more than one bag to carry, and they become difficult and awkward to handle. A compact, light weight, hand held carrying device, that can easily be stored in a pocket or handbag will allow a customer to carry multiple plastic bags comfortably using one hand in an organized manner. This will save the customer time and aggravation when carrying, loading, transporting and unloading one or more bags.

DESCRIPTION OF PRIOR ART

In the past, plastic grocery store bags with handles have been carried uncomfortably using one or two hands. When transporting the bags in an automobile, the bags tend to shift and slide, making them difficult to gather and reorganize. This method of carrying and transporting plastic grocery store bags, make it difficult to keep the bags organized and contained. It also increases the amount of stress that is put directly on the hands and fingers when carrying multiple bags.

One known carrying device is the "Carrying Member" U.S. Pat. No. 4,772,059, which is constructed of an injection molded polypropylene material. The carrying member is comprised of an upper gripping portion, the ends of which continue into outside portions, extending downward to a lower bag handle receiving region. The lower receiving region is used to carry one or more plastic bags by slipping them up through a gap and fitting them onto two support arms. A problem associated with this prior art is having to balance an equal number of bags on each support arm to insure proper balance. When carrying only one bag you must separate the individual handle portions of the bag and fit them individually on the two support arms balancing the load at the middle of the carrying member.

Another known carrying device is U.S. Pat. No. 5,599,052. The bag carrier is a flat design comprised of a horizontal upper handle section, connected to a horizontal lower hook support section by connecting vertical members. Multiple hooks on the bag carrier allow for bags to be attached or removed from the carrier. A problem associated with this prior art device is the time consuming task of attaching each bag to a separate hook and then removing each bag from a separate hook when using this device. The device is also constructed of a rigid material, which does not completely eliminate the stress put directly on the fingers. No device is known however, that can be used to carry multiple plastic grocery store bags comfortably, using a foam covered handle, and a single fastening device with a quick release safety gate that allows the user to attach multiple bags quickly and easily.

SUMMARY OF THE INVENTION

The principle object of the present invention is to provide a carrying device that attaches directly to the plastic handles on plastic bags commonly found in supermarkets, discount stores, drug stores, or any other industry using plastic bags. It also is an object of the present invention to allow a customer to carry multiple bags using one hand comfortably eliminating the amount of stress that is placed directly on the fingers and hand. Another object is to provide a device that will keep the bags grouped together and organized, allowing the customer to easily carry them, load them into the automobile, transport them in the automobile, and unload the bags when leaving the automobile. A further object is to provide such a device that can easily be stored in a handbag, purse, or pant pocket when not in use.

The foregoing can be accomplished by providing a carrying device, that is compact in size, and has a foam covered handle, with a fastening device that attaches to the handles of commonly used plastic bags. In the preferred embodiment of the invention, the horizontal handle is tubular in shape, and covered with a foam handgrip. The inside of the tubular shaped handle, will be hollow, to allow a nylon strap, to be inserted directly through the center of the rigid tubular shaped handle. A fastening device will be suspended from the horizontal handgrip, by a nylon strap, and attached by either a straight stitch or x-tack sewing stitch.

5. BRIEF DESCRIPTION OF THE DRAWINGS

FIG. 1. Is a front view of the Bag Carrying Device in accordance with the present invention.

Figure 2:
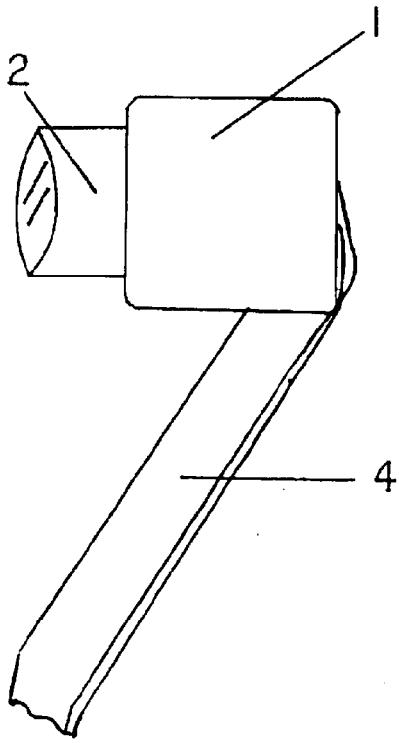

FIG. 2. Is a fragmentary, enlarged perspective of the rigid plastic foam covered handle.

Figure 3:
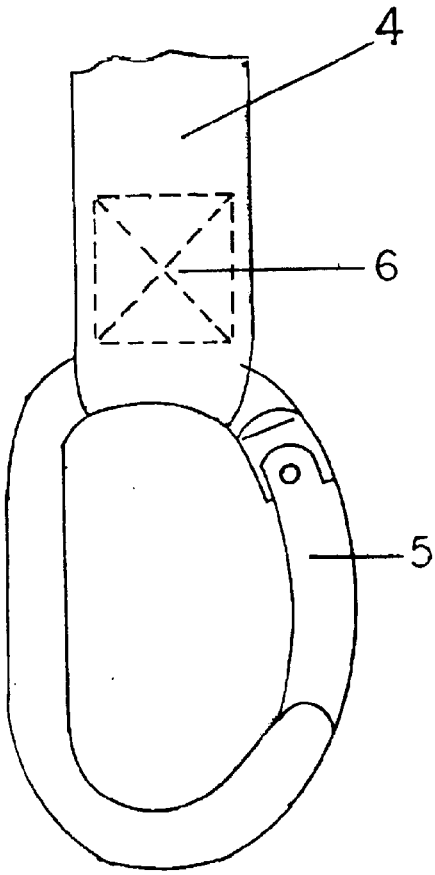

FIG. 3. Is a fragmentary, enlarged side elevation of the 3" fastening device attached to the nylon strap.

Figure 4:
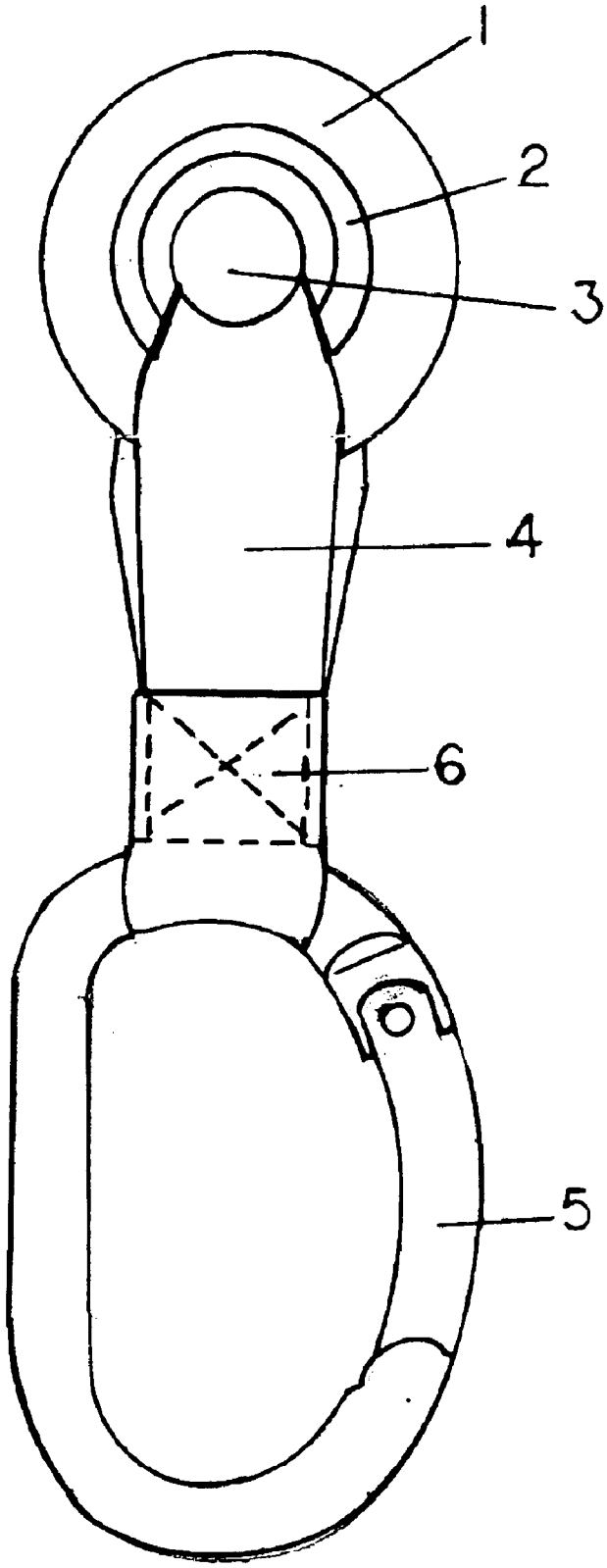

FIG. 4. Is a side elevation of the Bag Carrying Device in accordance with the present invention.

DETAILED DESCRIPTION OF THE DRAWINGS

As shown in the drawings, the preferred Bag Carrying Device, in accordance with the present invention, includes a 5" long horizontal foam covered handle of tubular shape 1. which preferably is of a strong molded PVC or Poly-plastic material 2. The inside of the tubular shaped handle will be hollow 3. allowing preferably a 17½" long nylon strap 4. to be inserted directly through the center of the rigid tubular handle 3. which will be attached to a 3" fastening device with a safety gate that opens and closes allowing bag handles to be inserted onto the fastening device 5. suspended from the horizontal handgrip 1. by a nylon strap 4. and attached with either a straight stitch or x-tack sewing stitch 6.

In use, the Bag Carrying Device will allow for an individual to carry multiple plastic grocery bags with the use of one hand comfortably.

When transporting the bags in an automobile, the device will easily contain all bags in one area, and prevent the bags from sliding and shifting, making it faster and easier when gathering bags upon departure of the automobile.

The Bag Carrying Device can also carry handbags, briefcases, and any other bags with handles.

I claim:

1. A bag carrying unit comprising:

a rigid horizontal foam covered handle of tubular shape which is hollow through the center; having opposite ends;

a flexible connecting member having two ends inserted directly through the center of said rigid horizontal foam covered tubular shaped handle extending and tapering downward from both ends of said rigid horizontal foam covered tubular shaped handle;

a fastening device with a safety gate with sewn means of adjoinment to both ends of said flexible connecting member suspended and tapering downward from said rigid horizontal foam covered tubular shaped handle.

2. The bag carrying unit in claim 1 whereas said rigid horizon 1 tubular shaped handle is plastic and is covered with a foam hand grip.

3. The bag carrying unit in claim 1 whereas said flexible connecting member is comprised of nylon.

4. The bag carrying unit in claim 1 whereas said fastening device has a pivoting safety gate.

* * * * *